United States Patent [19]

Hajek

[11] Patent Number: 4,517,219

[45] Date of Patent: May 14, 1985

[54] ELECTROSTATIC POWDER COATING CONTROL APPARATUS AND METHOD

[75] Inventor: Bedrich Hajek, New Haven, Conn.

[73] Assignee: Electrostatic Equipment Corp., New Haven, Conn.

[21] Appl. No.: 543,858

[22] Filed: Oct. 20, 1983

[51] Int. Cl.[3] ..... B05D 1/24

[52] U.S. Cl. ..... 427/8; 427/9; 427/27; 427/33; 427/185; 118/405; 118/406; 118/624

[58] Field of Search ..... 427/9, 27, 32, 33, 185, 427/8; 118/624, 406, 405, 400; 301/126; 206/389

[56] References Cited

U.S. PATENT DOCUMENTS

| | | | |
|---|---|---|---|
| 955,251 | 4/1910 | Criess | 301/126 |
| 2,315,640 | 4/1943 | Morse et al. | 206/389 |
| 3,641,976 | 2/1972 | Corneau | 427/27 |
| 3,914,461 | 10/1975 | Goodridge | 427/33 |
| 4,148,441 | 4/1979 | Cohen | 206/389 |
| 4,329,377 | 5/1982 | Voelker | 427/9 |

*Primary Examiner*—Richard Bueker

[57] ABSTRACT

Apparatus for coating wire and the like includes a build control bar that projects horizontally, into the cloud chamber of an electrostatic fluidized bed coating unit, from a supporting carriage. The carriage permits facile movement of the control bar to vary its extension into the coating chamber, and means is provided thereon for changing the angular orientation of the bar by rotating it about its axis, to thereby dispose in working position any of a plurality of longitudinally extending different surface portions. The latter vary from one another in width dimensions and/or configuration, and thereby providing a masking member that can readily be adapted to correspond to the width and/or configuration of a workpiece.

19 Claims, 8 Drawing Figures

ELECTROSTATIC POWDER COATING CONTROL APPARATUS AND METHOD

BACKGROUND OF THE INVENTION

A technique that is now widely used for insulating wires, and for producing coatings for other purposes, entails the exposure of a grounded workpiece to a cloud of electrostatically charged fusible particles, thereby causing the particles to deposit thereupon for subsequent integration. A well-recognized problem associated with the foregoing technique concerns the achievement of a uniform build upon the workpiece. When the apparatus employed is a fluidized bed unit the problem is most significant from the standpoint of achieving top-to-bottom uniformity, the lower surfaces of the wire tending to achieve a heavier build than the upper surfaces, primarily because they are closest to the source of the particle cloud.

The prior art has recognized these characteristics of electrostatic fluidized bed coating, and has proposed various solutions to the inherent problems. One effective approach is described and claimed in U.S. Pat. Nos. 4,297,386 and 4,330,567, to Gillette, wherein the characteristics of the particle cloud are controlled by electrical means. It is also common practice to mask the workpiece to control build, by interposing a physical barrier between it and the cloud, such as may be done by passing a wire to be coated through a tubular member, the extension of which into the coating chamber may be altered to vary the effective length of the workpiece exposed; this method is described, for example, in Beebe et al U.S. Pat. No. 3,396,699. Although the tubes utilized therein create a condition of either full exposure or full masking of the enclosed length of the workpiece, means for masking only a portion of the periphery is also known, as is disclosed in U.S. Pat. No. 4,011,832, to Westervelt, et al.

In any event, the configuration of the build control means utilized, as well as the effective distance over which it influences the deposit on the workpiece, will have a very significant effect upon the nature of the coating produced. This is especially so if only a portion of the workpiece periphery is to be masked by the control member, or if close control is to be achieved, in which case the dimensions and configuration of the barrier must normally be made to correspond substantially to the dimensions and configuration of the article being coated. It is necessary, moreover, that any commercially practicable electrostatic powder coating system be suited for use with a variety of workpieces, thus normally making a single build control member inadequate for optimal results.

Accordingly, it is a primary object of the present invention to provide a novel electrostatic powder coating system, which is capable of producing a controlled build of powder upon any of a variety of continuous length workpieces which differ from one another in dimensions and/or configurations.

It is a more specific object of the invention to provide such a system wherein the distance over which the workpiece is exposed to the powder cloud can readily be varied, thereby enabling facile alteration of the build.

It is also an object of the invention to provide a system having the foregoing features and advantages, in which the effective length and configuration of the build control member can be altered remotely and/or automatically, in response either to operator control or to a signal generated and fed back within the system.

Additional objects of the invention are to provide a novel method by which such build control is provided for the electrostatic powder coating of a workpiece, and to provide novel apparatus by which such control is achieved.

SUMMARY OF THE INVENTION

It has now been found that certain of the foregoing and related objects of the invention can readily be attained in a system for the electrostatic powder coating of a continuous length workpiece, utilizing novel build control apparatus, an electrostatic fluidized bed coating unit, and means for conveying at least one continuous length workpiece along a preselected travel path. The build control apparatus comprises at least one elongated rectilinear build control bar, peripherally configured to define a plurality of longitudinally extending surface portions which differ from one another in width dimensions and/or contour, or cross-sectional configuration. The apparatus also includes means for supporting the bar in a generally horizontal attitude, for rotating it about its longitudinal axis to angularly displaced positions in which the different portions are upwardly oriented, and for extending and retracting the bar to vary its projected length. The coating unit is located adjacent the build control apparatus, and is positioned to permit extension of the control bar thereinto, the conveying means being adapted to transport the workpiece along a generally horizontal travel path over the control bar and through the coating chamber. The control bar is so oriented as to dispose the corresponding surface portion thereof directly under the workpiece, and is so extended as to effectively mask the workpiece from a portion of the cloud of charged particles generated therebelow, thereby producing the desired build of powder thereupon.

In the preferred embodiments, the system includes means for automatically adjusting the extension of the bar, which means is most desirably responsive to a signal that is indicative of the build on the workpiece. Generally, this will be accomplished by additionally including in the system means for sensing the characteristics of the build, for generating a signal that is indicative thereof (normally by reference to the product), and for feedback of the signal to the adjusting means. It will also be preferred that the system include means for selectively rotating the control bar of the apparatus to each of the angularly displace positions thereof, and most desirably such rotating means will be capable of remote control.

Other objects of the invention are attained by the provision of a method for the electrostatic powder coating of a continuous length workpiece. In accordance therewith, the workpiece (normally grounded) is conveyed along a horizontal path proximate to an electrostatic fluidized bed unit, to effect the deposit thereupon of electrostatically charged powder particles from a cloud generated in the coating chamber. An elongated rectilinear build control bar, as previously described, is interposed under the workpiece; it is selectively rotated to upwardly dispose an appropriate one of its surface portions, and is extended, as necessary, to effectively mask the workpiece from a portion of the cloud of charged particles. Further objects are attained by the provision of build control apparatus, of the nature described hereinabove and hereinafter. Essentially, it will include a multi-sided elongated rectilinear build control bar, and means for supporting the bar in a generally horizontal attitude, for rotation and extension.

DETAILED DESCRIPTION OF THE ILLUSTRATED EMBODIMENTS

Figure 1:
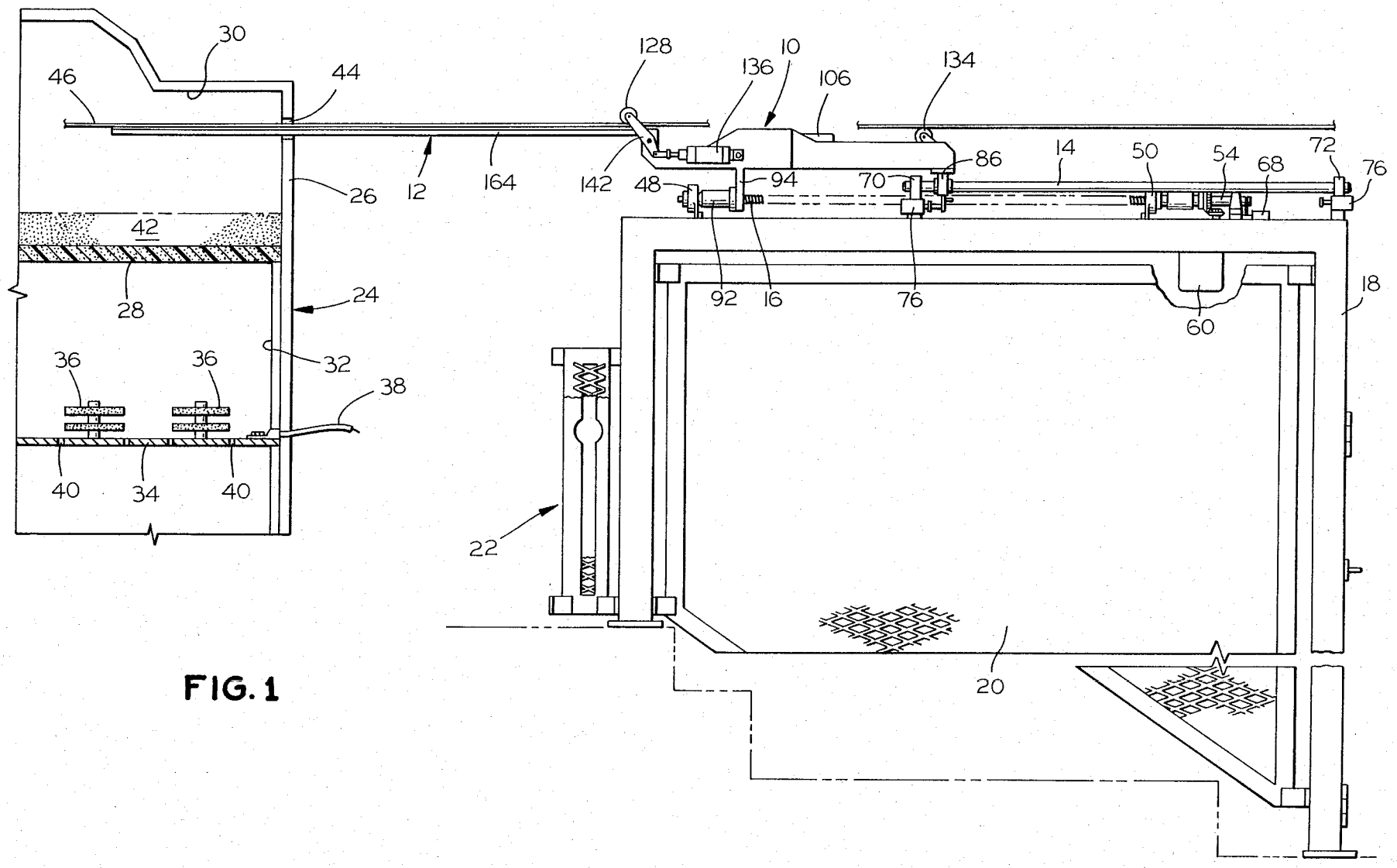
FIG. 1 is a fragmentary side elevational view of apparatus embodying the present invention, shown positioned for cooperation with an electrostatic fluidized bed powder coating unit.

Turning now in detail to FIG. 1 of the appended drawings, therein illustrated is build control apparatus embodying the present invention, which includes a carriage assembly, generally designated by the numeral 10, on the forward end of which is mounted a horizontally extending build control fixture bar, generally designated by the numeral 12. The carriage assembly 10 is slidably supported upon a pair of parallel rods 14 (only one of which is visible in this Figure), and is coupled to a lead screw 16, the support rods and lead screw in turn being mounted upon the frame 18. A displaceable door 20 of expanded metal construction is disposed within the frame 18, to permit access to the underlying regions.

Also shown in FIG. 1 is a diagrammatically illustrated control subsystem, generally designated by the numeral 22, and a similarly illustrated electrostatic fluidized bed coating unit, generally designated by the numeral 24. The control subsystem 22 may be regarded to include such features as are necessary for electrical and pneumatic control of operation of the equipment, for feedback of signals from the product which are indicative of the nature of the coating produced, for computerization of operation, etc., as will be evident to those skilled in the art.

The coating unit may be constructed in accordance with the teachings of the prior art, as set forth, for example, in U.S. Pat. Nos. 3,916,826 and 4,101,687 to Knudsen, 4,030,448 and 4,084,018 to Karr, and 4,297,386 and 4,330,567 to Gillette. Suffice to say that the unit 24 consists of a housing 26, which is divided by a generally horizontal porous support plate 28 into an upper coating chamber 30 and an underlying plenum chamber 32. Within the plenum chamber 32 is disposed a metal support plate 34, on which is positioned a multiplicity of brush-like electrode structures 36. The plate 34, and consequently the electrode structures 36 which are in electrically conductive contact therewith, may be charged from an appropriate high voltage source (not shown) through the cable 38. Air charged (by means also not shown) into the portion of the plenum 32 beneath the metal plate 34 passes upwardly through appropriately located apertures 40 into contact with the ends of the bristles of the electrode brushes 36. The thus ionized air then proceeds upwardly through the porous support plate 22, to fluidize and electrostatically charge the powder 42 supported on the plate 28, in a manner now well known in the art. As will be noted, the end wall of the housing 26 is slotted at 44, to permit entry of the build control bar 12 thereinto and passage of the wire workpiece 46 therethrough; although not shown it will be appreciated that the slot is of substantial length to accommodate a number of side-by-side wires and associated build control bars.

The wire 46 will of course normally be grounded to attract the charged particles, thereby to develop a coating of the powder thereupon. As will also be appreciated, the depth of penetration of the bar 12 into the chamber 30 will determine its effect upon powder build, the greater the penetration the more pronounced the effect will be.

Figure 2:
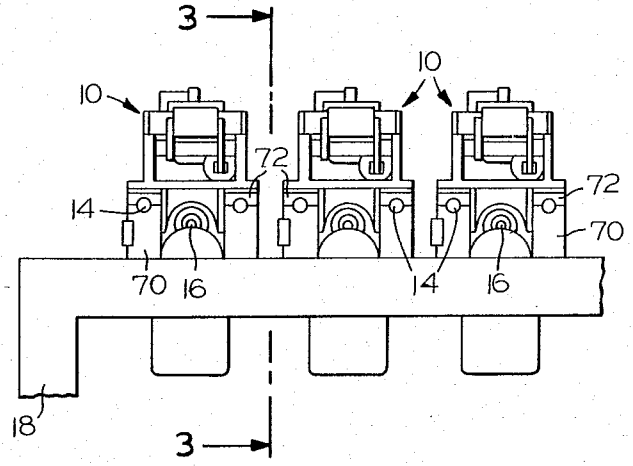
FIG. 2 is a fragmentary end view of the apparatus of FIG. 1, as viewed from the right-hand side thereof and drawn to a scale greatly enlarged therefrom.

FIG. 2 depicts three carriage assemblies 10, each of which carries a build control bar 12 (not shown), is slidably mounted upon a pair of parallel rods 14, and is driven by a lead screw 16. The apparatus of the invention will normally be utilized in a line designed for the simultaneous coating of a multiplicity of continuous length wires (typically, four or five), arranged side-by-side in a horizontal plane; consequently, it will include a corresponding number of carriage assemblies and support and drive mechanisms, arranged as indicated herein.

Figure 3:
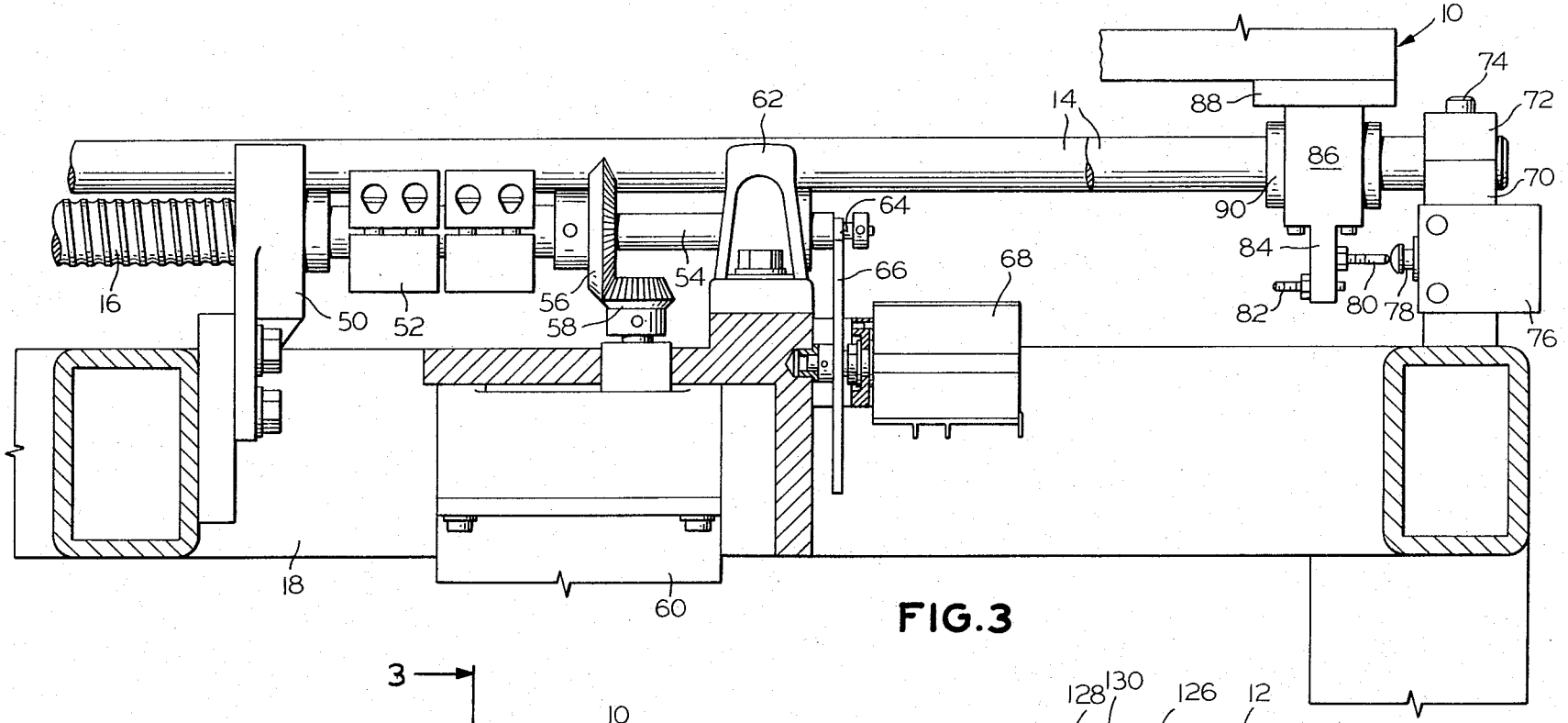
FIG. 3 is a fragmentary side elevational view showing the support and driving mechanisms utilized in the apparatus of the foregoing Figures, taken along line 3—3 of FIG. 2 and drawn to a scale further enlarged therefrom.

With additional reference now to FIG. 3, it is seen that the opposite ends of the lead screw 16 are journalled in bracket supports 48, 50, which are bolted to suitable pieces on the frame 18 of the apparatus and carry internal ball bearing assemblies (not shown). A coupling unit 52 connects the inner end of the screw 16 to a drive shaft 54, on which is affixed a bevel gear 56. The latter is driven by mating gear 58 which is, in turn, affixed on the shaft of a gear motor 60. Pillow block 62 supports the shaft 54, the latter having a pinion 64 in meshing engagement with the drive gear 66 of a potentiometer 68, which is utilized to generate a positionally representative electrical signal, to thereby permit accurate control (such as through the subsystem 22) of the extension of the bar 12 on the carriage 10 by driven engagement with the lead screw 16, as will be more fully described hereinbelow.

The ends of the guide rods 14 are affixed upon pairs of upstanding blocks 70 by the clamping pieces 72, which are fastened thereto by bolts 74. A limit switch 76 is also mounted on one of the blocks 70 adjacent the opposite ends of each pair of rods 14, and has a plunger 78 positioned for contact by one of the two fingers 80, 82, which project in opposite directions from a depending flange 84 of a pillow block 86. The block 86 is centrally disposed on a crosspiece 88 of the body of the assembly 10 and defines a pair of side-by-side openings, each mounting a linear bearing 90 in which is slidably engaged one of the guide rods 14. This construction permits smooth and stable movement of the carriage assembly 10 along the full length of the apparatus bed, with the limit switches 76 serving of course to prevent overrunning in either direction.

A wiper unit 92 is bolted to a centrally located depending flange portion 94 of the carriage body, both having passageways (only that of the flange portion, designated 96, being visible) therethrough to receive the lead screw 16. The wiper assembly 92 mounts a ball nut 93 which threadably engages the screw 16, thus causing the carriage assembly 10 to move longitudinally in either direction, depending upon the direction of rotation of the lead screw; the wiper assembly serves to clean the screw of powder that might otherwise accumulate thereon.

Figure 6:
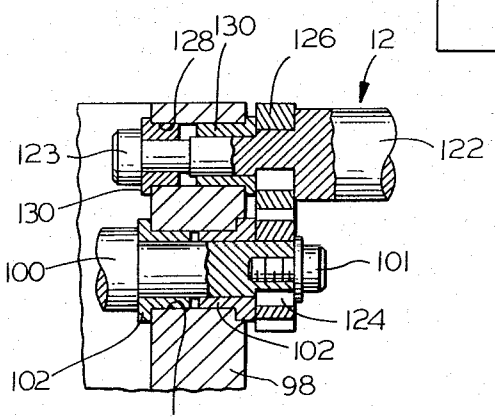
FIG. 6 is an enlarged fragmentary view in partial vertical section, illustrating adjacent end portions of the build-control fixture bar and its drive shaft, and showing details of the bearing supports and the gear coupling therebetween.

An upper portion 98 of the same carriage body part supports one end of a drive shaft 100, which is jounalled by a pair of flanged bearings 102 mounted within an aperture 104 thereof (as illustrated in FIG. 6). The opposite end of the shaft 100 is connected to the shaft of a second gear motor 106; three cam elements 108, 110, 112 are affixed at intermediate positions on the shaft 100 to operate corresponding limit switches 114, 116, 118, which are disposed therebelow and have follower elements 120 in contact with the cam surfaces thereof. The shaft 100 is also coupled to the adjacent end portion 122 of the build control bar 12 through a helical gear 124 and gear segment 126 affixed thereon by bolts 101, 123, respectively, the upper portion 98 of the carriage body being apertured at 128 and carrying flanged bearing elements 130 to support the end portion 122.

As will be described in greater detail hereinbelow, the motor 106 is employed to rotate the control bar 12, operating thereupon through the drive shaft 100. The cam elements 108, 110, 112 and the limit switches 114, 116, 118 correspond to three significant angular orientations of the bar 12 about its axis, and serve to stop rotation when the selected position has been attained.

Figure 4:
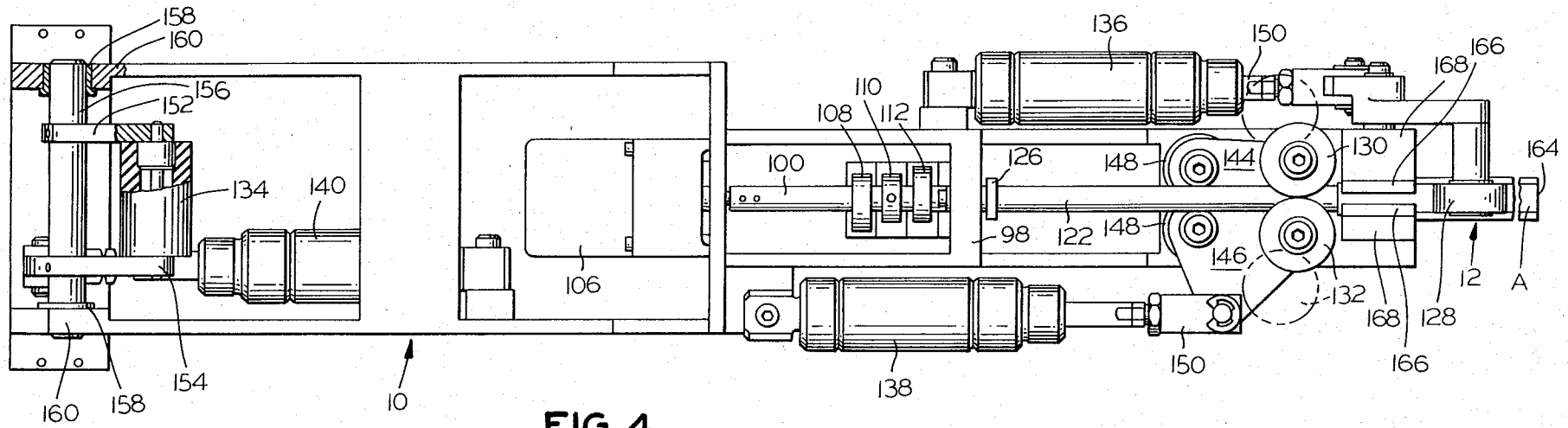
FIG. 4 is plan view of the carriage assembly of the apparatus, drawn substantially to the scale of FIG. 3 but showing the apparatus in reverse orientation.
Figure 5:
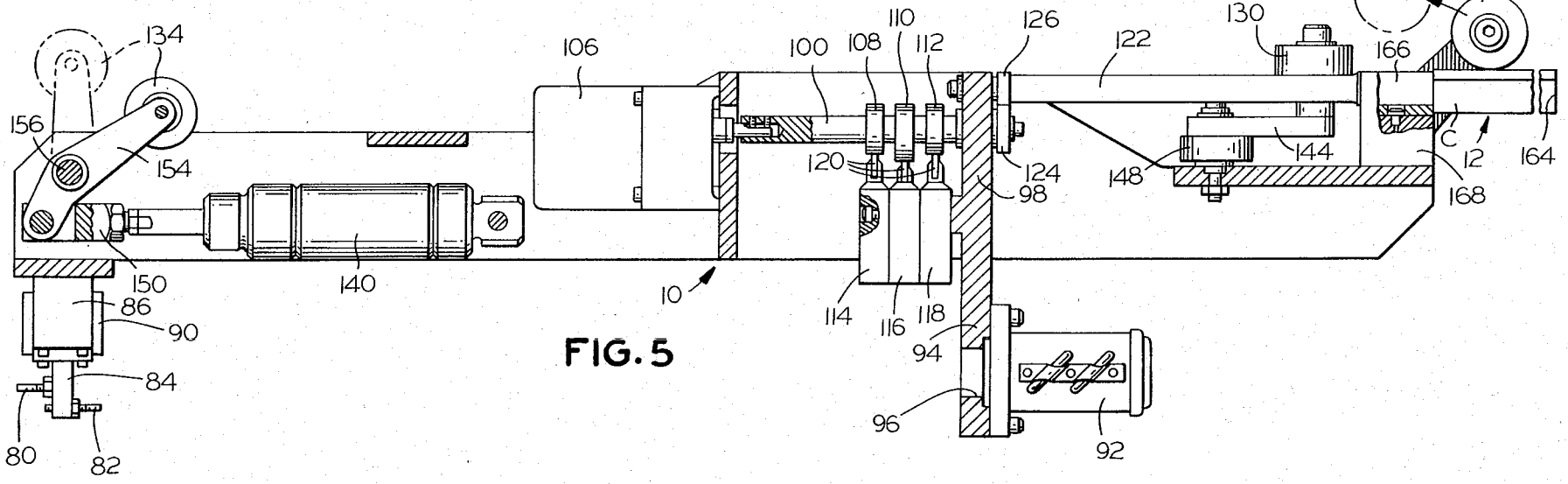
FIG. 5 is a side elevational view of the carriage assembly disposed as in FIG. 4, showing portions in partial vertical section.

As seen in FIGS. 1, 4 and 5, the carriage 10 also mounts a number of rollers 128, 130, 132 and 134, which cooperate with pneumatic piston units 136, 138, 140 (which may be connected to a manifold and four-way valves in the subsystem 22) to maintain the wire workpiece 46 in proper position with respect to the carriage and, more particularly, with respect to the build control bar 12. The pneumatic unit 136 is connected to the roller 128 through a pivotably mounted lever arm 142. Consequently, when the cylinder is appropriately pressurized, the roller 128 exerts a downward bias upon the wire which passes thereunder and along the length of the bar 12; pressure in the opposite direction will elevate the roller 128 to the phantom line position of FIG. 5, to enable release of the workpiece. In a similar manner, the unit 138 normally exerts a closing bias upon both of the rollers 130, 132, which are mounted respectively upon pivotable web pieces 144, 146, which are in turn operatively interconnected by the meshing pinions 148. The pneumatic unit 138 is connected through a clevis 150 to operate the piece 146, and the rollers 130, 132 can be shifted to the alternative positions shown in phantom line in FIG. 4, to effect release of wire 46. The rearmost roller 134 (i.e., the one first encountered by the wire as it passes over the control apparatus) is rotatably mounted between a pair of flanges 152, 154, which are joined to the shaft 156, the latter being journalled between the flanged bearings 158 supported within body sidewall portions 160. The arm 154 is attached through a clevis 150 to the pneumatic unit 140 which, in normal operation, is in the lower position shown, providing underlying support for the workpiece; elevating the roller 134 lifts the wire away from the carriage 10, and facilitates removal.

Figure 7:
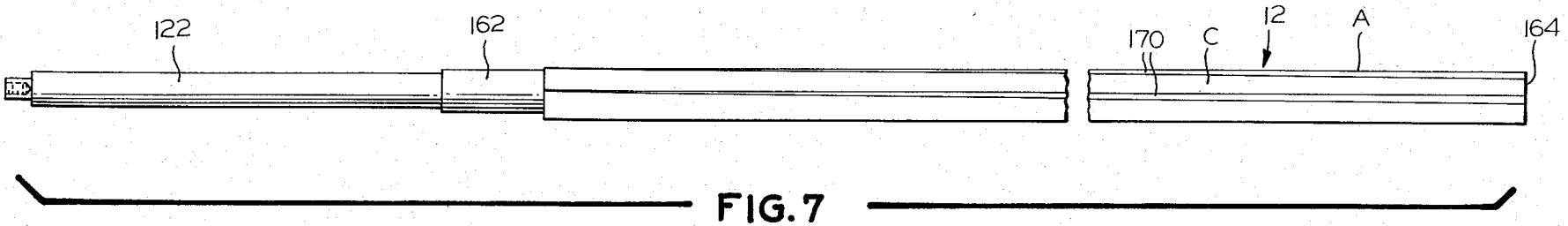
FIG. 7 is a fragmentary elevational view of the build-control fixture bar utilized in the apparatus of the invention.
Figure 8:
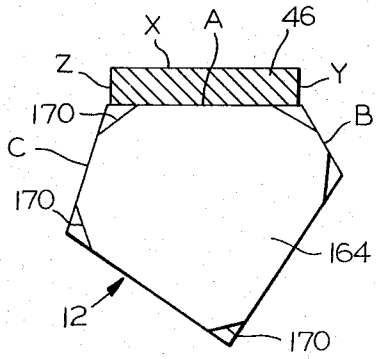
FIG. 8 is an enlarged end view of the build control bar, taken from the right-hand side of FIG. 7 and showing a rectangular wire workpiece moving along one of the planar surface portions defined on its periphery.

With additional reference finally to FIGS. 7 and 8, it can be seen therein that the build control bar 12 includes an intermediate bearing portion 162, and a leading end portion 164 of unique configuration. The intermediate portion 162 is supported on the body of the carriage 10 between a pair of bearing pieces 166, which are in turn affixed to support blocks 168, permitting rotation of the bar by the motor 106, as previously indicated.

The leading end 164 of the bar 12 is generally rectilinear, but has been machined to define five longitudinally extending peripheral surface portions of planar cross-sectional configuration, three of which, designated "A", "B", and "C", are of particular significance and may be designated the working surface portions. As indicated above, the principal difficulty in achieving a uniform coating upon such a workpiece involves the weight of the build from the top to the bottom of the wire, the bottom surface tending to develop a much heavier coating than the top. By utilization of the underlying control bar 12, the upper surface (designated "x" in FIG. 8) of the wire 46 will be exposed at all times during residence in the chamber 30, whereas the amount of exposure of the bottom surface can be closely controlled. This is done by adjusting the extension of the leading end portion 164 (which will typically be about four feet long) into the chamber 30, to effectively vary the distance over which the lower surface of the workpiece will be exposed to the cloud of charged particles generated thereunder.

As seen in FIG. 8, the surface "A" is dimensioned to extend completely across the wire 46 (actually slightly beyond), while being sufficiently narrow as to avoid blocking the powder from the side edges "Y" and "Z"; the surfaces "B" and "C" are dimensioned to provide similar masking for other standard widths of wire. More specifically, at the widest point the surface "A" may be about 0.624 inch, surface "B" may be about 0.274 inch, and surface "C" may be about 0.45 inch. The end portion 164 is also provided with forwardly tapering bevelled edges 170; this enables use of each of the planar surface portions "A", "B" and "C" for wires within a range of sizes. The unlettered surface portions of the control bar are provided primarily for clearance, so as to avoid any undue interference with coating of the workpiece, specifically with respect to the right side of the wire when surface "B" is in working position, and with respect to the left side when surface "C" is used. Ideally, both surfaces adjacent each working surface will form the same angle therewith, so as to ensure that an identical effect is produced upon the powder carried to both sides of the workpiece.

Despite the fact that the drawings illustrate use of the apparatus of the system in connection with rectangular wire, it should be appreciated that the same may be equally well suited for use in the coating of continuous length workpieces of other configurations. For example, it may be employed for round wire, in which instance the control bar surface portions would be appropriately contoured, such as by providing longitudinally extending grooves of rounded (e.g., semi-circular) cross-section. Further modifications to the fixture bar surface portions, to adapt the apparatus for workpieces of other configurations, will readily occur to those skilled in the art.

As has been indicated previously, it will generally be necessary to relieve the longitudinal portions of the fixture bar adjacent to the working surfaces so as to avoid undue interface with powder movement, and normally it will be most advantageous to make the adjacent portions identical, to ensure side-to-side uniformity. In this regard, it is to be appreciated that the unlettered planar surface portions shown in FIGS. 7 and 8 of the drawings are not intended to constitute "working" surfaces, but are provided for the purpose just described.

As will also be appreciated, the overall system utilized to achieve the electrostatic powder coating of a continuous length workpiece will have a considerable amount of equipment which has not been illustrated, since it does not constitute a part of the present invention. For example, there will be appropriate pay-off and take-up stations for the wire, apparatus for cleaning it in preparation for coating, and ovens and the like for fusing or curing the powder to effect its integration prior to solidification, for which suitable means may also be provided. The specific design and features of any control subsystem used (which may, as mentioned, constitute a part of certain embodiments of the invention) will be evident to those skilled in the art in view of the desirable functions and purposes hereinabove described, and in many instances it will be advantageous to adapt the system for either manual or automatic control. A computer subsystem may be installed to facilitate automatic control, such as to adjust the control bar to compensate for deviations in the thickness of the build, or to shift the bar to bring into use a different surface portion.

Thus, it can be seen that the present invention provides a novel electrostatic powder coating system, which is capable of producing a controlled build of powder upon any of a variety of continuous length workpieces. The build control apparatus used in the system enables ready variation of the distance over which the workpiece will be exposed to the powder cloud, thereby affording facile alteration of the build; the effective length and configuration of the build control member can be altered remotely and/or automatically, in response either to operator control or to a signal generated and fed back within the system. The invention also provides a novel method by which such build control is provided for the electrostatic powder coating of a workpiece.

Having thus described the invention, what is claimed is:

1. In a system for the electrostatic powder coating of a continuous length workpiece, wherein the build upon the workpiece is controlled, the combination of including:

a. build control apparatus comprising (1) at least one elongated rectilinear build control bar peripherally configured to define thereabout a plurality of longitudinally extending surface portions, said surface portions differing from one another in width dimensions and/or cross-sectional configuration; and (2) means for supporting said bar in a generally horizontal attitude with a leading end portion thereof unsupported, said supporting means being capable of rotating said bar about its longitudinal axis to angularly displaced positions thereabout to upwardly orient a different one of said surface portions in each of said positions, and of extending and retracting said bar to vary the projected length thereof;

b. an electrostatic fluidized bed coating unit located adjacent said build control apparatus, in position to permit extension of said leading end portion of said build control bar of said apparatus into the coating chamber thereof; and c. means for conveying at least one continuous length workpiece along a travel path over said control bar and through said coating chamber of said electrostatic fluidized bed unit; whereby said system can be used to produce a controlled build of powder upon a continuous length workpiece, the workpiece being conveyed through said coating chamber with said control bar interposed therebeneath, said bar being selectively rotated to dispose under the workpiece one of said surface portions appropriately corresponding to the cross-sectional dimensions and configuration thereof, and being extended to effectively mask the workpiece from a portion of the cloud of charged particles generated thereunder in said fluidized bed unit.

2. The system of claim 1 additionally including a control subsystem, said subsystem comprising means for automatically adjusting the extension of said bar to provide the desired build on the workpiece.

3. The system of claim 2 wherein said adjusting means is responsive to a signal that is indicative of the characteristics of the build on the workpiece.

4. The system of claim 3 wherein said control subsystem additionally includes means for sensing characteristics of the build on the workpiece, for generating a signal that is indicative thereof, and for feedback of the signal to said adjusting means.

5. The system of claim 1 additionally including means for selectively rotating said control bar to each of said angularly displaced positions thereof.

6. The system of claim 4 additionally including a control subsystem, said subsystem comprising means for remotely controlling said rotating means.

7. In a method for the electrostatic powder coating of a continuous length workpiece, wherein the build upon said workpiece is controlled, the steps comprising:

a. conveying a continuous length workpiece along a horizontal path proximate to an underlying electrostatic fluidized bed coating unit, to deposit thereupon electrostatically charged powder particles from a cloud thereof generated in said unit beneath said workpiece;

b. interposing between said workpiece and said cloud of particles an elongated rectilinear build control bar peripherally configured to define thereabout a plurality of longitudinally extending surface portions, and horizontally supported with a leading end portion thereof unsupported, said surface portions being different from one another in width dimensions and/or cross-sectional configuration;

c. selectively rotating said bar about its longitudinal axis to dispose, in an upward orientation directly under said workpiece, an appropriate one of said surface portions corresponding to the cross-sectional dimensions and configuration thereof; and d. extending said bar as necessary to enable said leading end portion to effectively mask said workpiece from a portion of said cloud, so as to thereby control the characteristics of the powder build produced thereupon.

8. The method of claim 7 wherein the extension of said bar is automatically adjusted to provide the desired build on said workpiece.

9. The method of claim 8 wherein said adjustment is made in response to a signal that is indicative of the characteristics of the build on said workpiece, and wherein said method includes steps for integrating said powder on said workpiece into a solidified coating, said signal being generated by means for sensing the nature of said coating upon said product.

10. The method of claim 7 wherein said control bar is remotely controlled to so dispose said surface portions thereof.

11. Build control apparatus for use in a system for the electrostatic powder coating of a continuous length workpiece, comprising an elongated rectilinear build control bar peripherally configured to define thereabout a plurality of longitudinally extending surface portions, said surface portions being different from one another in width dimensions and/or cross-sectional configuration; and means for supporting said bar in a generally horizontal attitude with a leading end portion thereof unsupported, said supporting means being capable of rotating said bar about its longitudinal axis to angularly displaced positions thereabout with a different one of said surface portions being upwardly oriented in each of said positions, and of extending and retracting said bar to vary the projected length thereof, whereby said apparatus can be used in conjunction with an electrostatic fluidized bed coating unit to control the build of powder deposited therefrom upon a continuous length workpiece.

12. The apparatus of claim 11 additionally including means for selectively rotating said control bar to each of said angularly displaced positions thereof.

13. The apparatus of claim 12 wherein said rotating means comprises an electric motor, and includes means connected to said motor for limiting rotation of said bar.

14. The apparatus of claim 11 wherein at least one of said surface portions of said bar is planar.

15. The apparatus of claim 11 wherein said bar is forwardly tapered to adapt said one surface portion for use in connection with workpieces within a range of different sizes.

16. The apparatus of claim 11 wherein said control bar has a multiplicity of working planar surface portions on the periphery thereof, surface portions of said bar adjacent to any one of said working surface portions forming the same angle therewith.

17. The apparatus of claim 11 wherein said supporting means for said control bar comprises a carriage assembly and a supporting frame, said carriage assembly being mounted on said frame for longitudinal movement in the axial direction of said control bar to effect such extension and retraction thereof.

18. The apparatus of claim 17 wherein said carriage assembly additionally includes means for positioning the workpiece with respect to said control bar, said positioning means being adapted to hold the workpiece in direct contact with an upwardly oriented surface portion of said bar, and for maintaining it in longitudinal alignment therewith.

19. The apparatus of claim 18 wherein said positioning means comprises a plurality of rollers mounted upon moveable parts, and pneumatic cylinders for shifting said parts to move said rollers between positions in contact with, and displaced from, the workpiece.

* * * * *